US012161238B2

(12) United States Patent
Hernandez

(10) Patent No.: US 12,161,238 B2
(45) Date of Patent: Dec. 10, 2024

(54) FOLDABLE SHELVING

(71) Applicant: Elizabeth Hernandez, Zion, IL (US)

(72) Inventor: Elizabeth Hernandez, Zion, IL (US)

( * ) Notice: Subject to any disclaimer, the term of this patent is extended or adjusted under 35 U.S.C. 154(b) by 0 days.

(21) Appl. No.: 18/090,823

(22) Filed: Dec. 29, 2022

(65) Prior Publication Data

US 2024/0215740 A1 Jul. 4, 2024

(51) Int. Cl.
*A47F 5/10* (2006.01)
*A47F 5/00* (2006.01)
*A47F 5/08* (2006.01)

(52) U.S. Cl.
CPC ..... *A47F 5/10* (2013.01); *A47F 5/0043* (2013.01); *A47F 5/08* (2013.01)

(58) Field of Classification Search
CPC .. A47F 5/10; A47F 5/0043; A47F 5/08; A47F 5/12; A47F 5/16; A47F 5/0018; A47B 5/04; A47B 46/00; A47B 57/045; A47B 96/027; A47B 96/028; A47B 96/022; A47B 5/00; D06F 81/06
USPC ..... 211/90.02, 90.04, 150, 103, 193, 149, 211/104; 108/42, 47, 48, 152, 134, 108, 108/2, 136, 9, 110, 179
See application file for complete search history.

(56) References Cited

U.S. PATENT DOCUMENTS 3,158,113 A * 11/1964 Johnson ..... A47B 96/025 211/104
4,357,881 A * 11/1982 De Long ..... A47B 23/02 211/88.01
4,605,131 A * 8/1986 Debus ..... A47B 5/04 108/134
4,830,243 A * 5/1989 Mann ..... A61H 3/00 108/88
5,408,936 A * 4/1995 Tseng ..... A47B 5/06 108/134
5,505,318 A * 4/1996 Goff ..... E04G 17/002 211/90.03
6,412,423 B1 * 7/2002 Elizondo, Jr. ..... A47B 83/045 211/104
6,464,091 B1 * 10/2002 Nagasaki ..... A47G 25/0685 211/104
8,281,943 B2 * 10/2012 Suman ..... A47F 5/0087 211/90.02
8,333,158 B2 * 12/2012 Wise ..... A47B 57/20 108/134
8,584,601 B1 * 11/2013 Deschner ..... B25H 1/04 108/134

(Continued)

*Primary Examiner* — Jennifer E. Novosad
(74) *Attorney, Agent, or Firm* — The Iwashko Law Firm, PLLC; Lev Ivan Gabriel Iwashko

(57) ABSTRACT

Foldable shelving, including at least one primary shelf removably disposed on at least a portion of an external surface to receive at least one first item thereon, a plurality of folding brackets movably connected to at least a portion of the at least one primary shelf to move from retracted against the external surface in a first position to at least partially extended away from the external surface along a length of the at least one primary shelf in a second position, and move from extended away from the external surface along the length of the at least one primary shelf in the second position to retracted against the external surface in the first position, and at least one secondary shelf removably disposed on at least a portion of the external surface to receive at least one second item thereon.

4 Claims, 1 Drawing Sheet

(56) References Cited

U.S. PATENT DOCUMENTS

| | | | | |
|---|---|---|---|---|
| 8,584,872 | B2 * | 11/2013 | Eiseman | E06C 7/143<br>211/130.1 |
| 8,944,621 | B2 * | 2/2015 | Driver | A47B 96/028<br>362/249.05 |
| 9,016,214 | B2 * | 4/2015 | Zang | A47B 91/02<br>211/187 |
| 10,568,423 | B1 * | 2/2020 | McDowell | A47B 96/1408 |
| 2010/0264103 | A1 * | 10/2010 | Johnson | A47B 57/20<br>211/150 |
| 2011/0068071 | A1 * | 3/2011 | Suman | A47F 5/0087<br>211/153 |

* cited by examiner

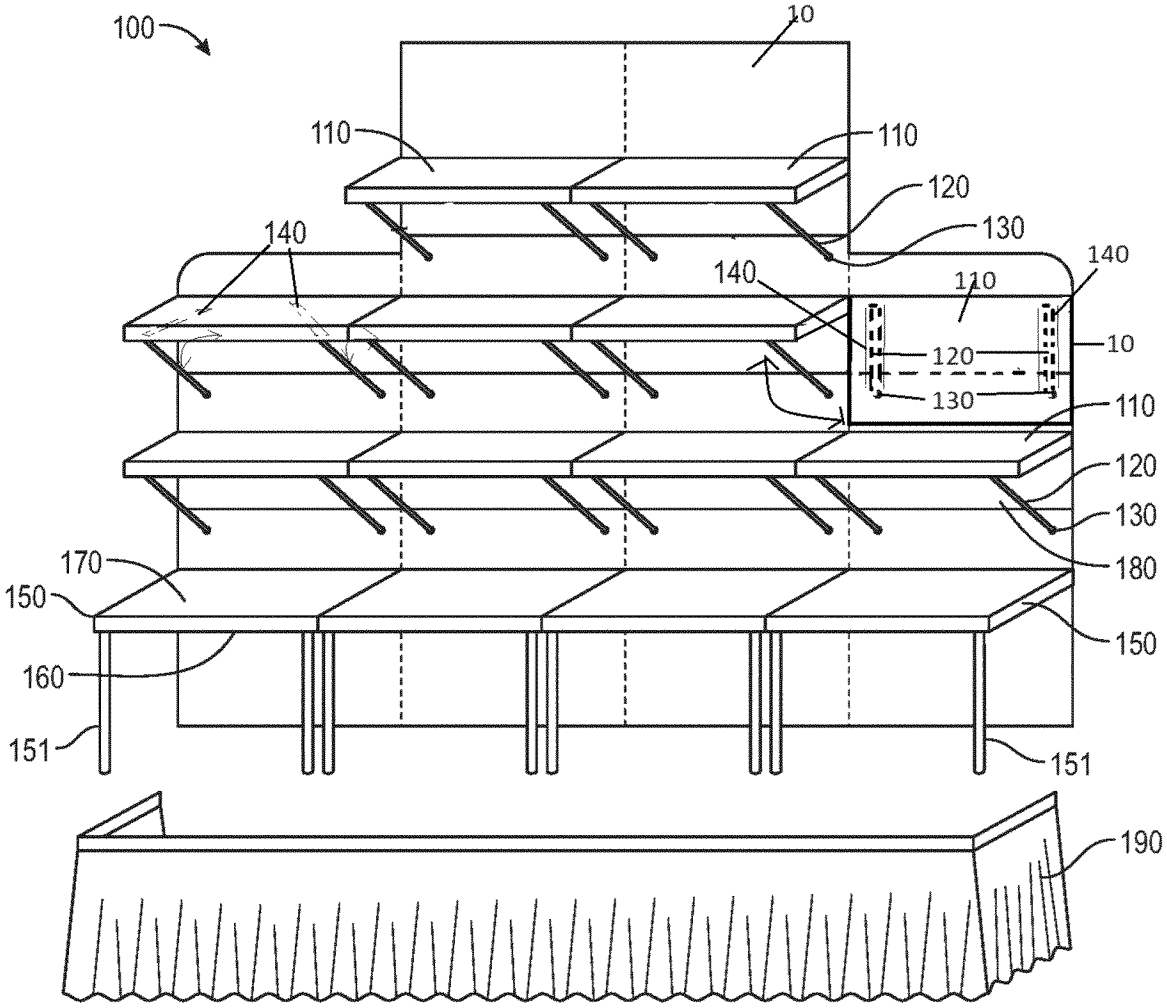
100
10
110
120
130
140
150
151
160
170
180
190

FOLDABLE SHELVING

BACKGROUND

1. Field

The present general inventive concept relates generally to shelves, and particularly, to foldable shelving.

2. Description of the Related Art

Shelves are a type of horizontal plane usually used for display and/or storage of items. Shelves are often used by business owners and/or a seller of crafted items at craft shows and/or farmer markets, beauty salons, and a host of other purposes.

However, most shelves used for display are bulky and/or take up vast amounts of space because they are fixed in design. Other shelves are part of a cabinet that is fixed in size and limits portability. As such, shelves are difficult to move which can be cumbersome when it comes time to disassemble and/or reposition inventory.

Therefore, there is a need for foldable shelving that adjusts positioning and easily installed and/or removed.

SUMMARY

The present general inventive concept provides foldable shelving.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing foldable shelving, including at least one primary shelf removably disposed on at least a portion of an external surface to receive at least one first item thereon, a plurality of folding brackets movably connected to at least a portion of the at least one primary shelf to move from retracted against the external surface in a first position to at least partially extended away from the external surface along a length of the at least one primary shelf in a second position, and move from extended away from the external surface along the length of the at least one primary shelf in the second position to retracted against the external surface in the first position, and at least one secondary shelf removably disposed on at least a portion of the external surface to receive at least one second item thereon.

The at least one primary shelf may be folded toward the external surface in response to the plurality of brackets being retracted against the external surface.

The at least one primary shelf may be perpendicularly disposed away from the external surface with respect to a direction in response to the plurality of brackets being fully extended away from the external surface.

The foldable shelving may further include a plurality of bracket receiving grooves disposed on at least a portion of the at least one primary shelf to receive the plurality of brackets therein.

The plurality of brackets may be nested within the plurality of bracket receiving grooves in response to folding the at least one primary shelf toward the external surface and the plurality of brackets are retracted against the external surface.

The foldable shelving may further include at least one extendable surface connected to the at least one secondary shelf to receive at least one third item thereon, and extend away from the at least one secondary shelf in a first position and retract under the at least one secondary shelf in a second position.

BRIEF DESCRIPTION OF THE DRAWINGS

These and/or other features and utilities of the present generally inventive concept will become apparent and more readily appreciated from the following description of the embodiments, taken in conjunction with the accompanying drawings of which:

FIG. 1 illustrates a side perspective view of foldable shelving, according to an exemplary embodiment of the present general inventive concept.

DETAILED DESCRIPTION

Various example embodiments (a.k.a., exemplary embodiments) will now be described more fully with reference to the accompanying drawings in which some example embodiments are illustrated. In the FIGURES, the thicknesses of lines, layers and/or regions may be exaggerated for clarity.

Accordingly, while example embodiments are capable of various modifications and alternative forms, embodiments thereof are shown by way of example in the figures and will herein be described in detail. It should be understood, however, that there is no intent to limit example embodiments to the particular forms disclosed, but on the contrary, example embodiments are to cover all modifications, equivalents, and alternatives falling within the scope of the disclosure. Like numbers refer to like/similar elements throughout the detailed description.

It is understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art. However, should the present disclosure give a specific meaning to a term deviating from a meaning commonly understood by one of ordinary skill, this meaning is to be taken into account in the specific context this definition is given herein.

LIST OF COMPONENTS

Foldable Shelving 100
Primary Shelf 110
Folding Brackets 120
Hinges 130
Bracket Receiving Grooves 140
Secondary Shelf 150
Secondary Legs 151
Extendable Surface 160
Surface Legs 161
Table Cover 170
Shelf Receiving Groove 180
Table Skirt 190

FIG. 1 illustrates a side perspective view of foldable shelving, according to an exemplary embodiment of the present general inventive concept.

The foldable shelving 100 may be constructed from at least one of metal, plastic, wood, and rubber, etc., but is not limited thereto.

The foldable shelving 100 may include at least one primary shelf 110, a plurality of folding brackets 120, a plurality of hinges 130, a plurality of bracket receiving grooves 140, a secondary shelf 150, an extendable surface 160, a table cover 170, a shelf receiving groove 180, and a table skirt 190, but is not limited thereto.

Referring to FIG. 1, the at least one primary shelf 110 is illustrated to have a rectangular prism shape. However, the at least one primary shelf 110 may be rectangular, circular, conical, triangular, pentagonal, hexagonal, heptagonal, octagonal, or any other shape known to one of ordinary skill in the art, but is not limited thereto.

The at least one primary shelf 110 may be removably disposed on at least a portion of an external surface 10 (e.g., a wall, a cabinet). The at least one primary shelf 110 may be a planar surface. The at least one primary shelf 110 may receive at least one first item thereon.

Each of the plurality of folding brackets 120 may be movably (i.e., slidably, pivotally) connected at a first end to at least a portion of the at least one primary shelf 110. More specifically, a first of the plurality of folding brackets 120 may be disposed on at least a portion of a first side of the at least one primary shelf 110. Moreover, a second of the plurality of folding brackets 120 may be disposed on at least a portion of a second side of the at least one primary shelf 110 opposite with respect to the first side.

Additionally, each of the plurality of brackets 120 may be movably (i.e., pivotally, rotatably) connected at a second end to at least a portion of the external surface 10. For example, the second end of each of the plurality of brackets 120 may be connected to the external surface 10 using at least one fastener, such as screws, nails, bolts, washers, nuts, adhesive (e.g., tape, glue), magnets, and/or any combination thereof. The plurality of brackets 120 may move from retracted against the external surface 10 in a first position to at least partially extended away from the external surface 10 along a length of the at least one primary shelf 110 in a second position. Conversely, the plurality of brackets 120 may move from extended away from the external surface 10 along the length of the at least one primary shelf 110 in the second position to retracted against the external surface 10 in the first position. The at least one primary shelf 110 may be angularly (e.g., perpendicularly) disposed at a first end away from the external surface 10 with respect to a direction while the plurality of brackets 120 are fully extended away from the external surface 10.

Furthermore, the plurality of brackets 120 may support the at least one primary shelf 110 thereon while the plurality of brackets 120 are fully extended away from the external surface 10.

The plurality of hinges 130 may be movably (i.e., rotatably) disposed on at least a portion of the second end of each of the plurality of brackets 120. As such, the plurality of hinges 130 may facilitate movement (i.e., rotation) of the plurality of brackets 120.

The plurality of bracket receiving grooves 140 may be disposed on at least a portion of the at least one primary shelf 110. More specifically, a first of the plurality of bracket receiving grooves 140 may be disposed on at least a portion of the first side of the at least one primary shelf 110. Moreover, a second of the plurality of bracket receiving grooves 140 may be disposed on at least a portion of a second side of the at least one primary shelf 110 opposite with respect to the first side.

Accordingly, a position of the plurality of brackets 120 may correspond to a position of the plurality of bracket receiving grooves 140 on the at least one primary shelf. Also, the plurality of brackets 120 may be nested within the plurality of bracket receiving grooves 140 in response to folding (i.e., rotating) the at least one primary shelf 110 toward the plurality of hinges 130 and/or the external surface 10 while the plurality of brackets 120 are retracted against the external surface 10. In other words, a second end of the at least one primary shelf 110 may move toward the plurality of hinges 130 and/or the external surface 10 in response to the plurality of brackets 120 being retracted against the external surface 10, such that the at least one primary shelf 110 is folded. As such, the plurality of bracket receiving grooves 140 may receive the plurality of brackets 120 therein.

Referring again to FIG. 1, the at least one secondary shelf 150 is illustrated to have a rectangular prism shape. However, the at least one secondary shelf 150 may be rectangular, circular, conical, triangular, pentagonal, hexagonal, heptagonal, octagonal, or any other shape known to one of ordinary skill in the art, but is not limited thereto.

The at least one secondary shelf 150 may include a plurality of secondary legs 151, but is not limited thereto.

The at least one secondary shelf 150 may be removably disposed on at least a portion of the external surface 10. The at least one secondary shelf 150 may be a planar surface. The at least one secondary shelf 150 may receive at least one second item thereon.

The at least one secondary shelf 150 may be disposed closer to a ground surface than the at least one primary shelf 110. Moreover, the at least one secondary shelf 150 may be in a fixed position. The at least one secondary shelf 150 may be angularly (e.g., perpendicularly) disposed at a first end away from the external surface 10 with respect to a direction similar to the at least one primary shelf 110.

The plurality of secondary legs 151 may be disposed on at least a portion of the at least one secondary shelf 150. The plurality of secondary legs 151 may support the at least one secondary shelf 150 thereon, such that the at least one secondary shelf 150 may be disposed away from the ground surface equivalent to a length of the plurality of secondary legs 151.

Referring again to FIG. 1, the at least one extendable surface 160 is illustrated to have a rectangular prism shape. However, the at least one extendable surface 160 may be rectangular, circular, conical, triangular, pentagonal, hexagonal, heptagonal, octagonal, or any other shape known to one of ordinary skill in the art, but is not limited thereto.

The at least one extendable surface 160 may include a plurality of surface legs 161, but is not limited thereto.

The at least one extendable surface 160 may be removably disposed on at least a portion of the external surface 10. The at least one extendable surface 160 may be a planar surface. The at least one secondary shelf 150 may receive at least one third item thereon.

The at least one extendable surface 160 may be disposed closer to a ground surface than the at least one second shelf 150. Moreover, the at least one extendable surface 160 may be constructed similar to the at least one secondary shelf 150 and/or may be connected to the at least one secondary shelf 150 via a plurality of rails, such that the at least one extendable surface 160 may extend away from the at least one secondary shelf 150 in a first position and/or retract under the at least one secondary shelf 150 in a second position. Referring again to FIG. 1, the at least one extendable surface 160 may be angularly (e.g., perpendicularly) disposed at a first end away from the at least one secondary shelf 150 with respect to a direction similar to the at least one primary shelf 110 and/or the at least one secondary shelf 150.

The plurality of surface legs 161 may be disposed on at least a portion of the at least one extendable surface 160. The plurality of surface legs 161 may support the at least one extendable surface 160 thereon, such that the at least one extendable surface 160 may be disposed away from the ground surface equivalent to a length of the plurality of surface legs 161.

The table cover 170 may include a skirt, a blanket, and a cloth, but is not limited thereto.

The table cover 170 may be removably disposed on at least a portion of the at least one primary shelf 110, the at least one secondary shelf 150, and/or the at least one extendable surface 160. As such, the table cover 170 may cover the at least one primary shelf 110, the at least one secondary shelf 150, and/or the at least one extendable surface 160 to prevent items stored under from being viewable.

The shelf receiving groove 180 may be connected to at least a portion of the at least one primary shelf 110, the plurality of brackets 120, and/or the plurality of hinges 130. The shelf receiving groove 180 may receive at least a portion of the at least one shelf 110 therein in response to folding the at least one primary shelf 110 toward the shelf receiving groove 180, such that the at least one primary shelf 110 may be stored within the shelf receiving groove 180. Also, the shelf receiving groove 180 may be recessed with respect to the external surface 10.

The table skirt 190 may be removably connected to at least a portion of the at least one secondary shelf 150 and/or the at least one extendable surface 160. In other words, the tablet skirt 190 may connect to the at least one secondary shelf 150 and/or the at least one extendable surface 160 via a fastener (e.g., a hook and loop fastener, an adhesive (e.g., tape, glue), a clip, a clamp, a clasp). As such, the table skirt 190 may surround and/or obscure an area within a boundary of the at least one secondary shelf 150, the at least one extendable surface 160, and/or the table skirt 190.

Therefore, the foldable shelving 100 may disposed at any location and/or on the external surface 10 to provide shelves for displaying and/or storing items. Also, the foldable shelving 100 may save space because of the ability to be folded and easily installed and/or removed.

The present general inventive concept may include foldable shelving 100, including at least one primary shelf 110 removably disposed on at least a portion of an external surface 10 to receive at least one first item thereon, a plurality of folding brackets 120 movably connected to at least a portion of the at least one primary shelf 110 to move from retracted against the external surface 10 in a first position to at least partially extended away from the external surface 10 along a length of the at least one primary shelf 110 in a second position, and move from extended away from the external surface 10 along the length of the at least one primary shelf 110 in the second position to retracted against the external surface 10 in the first position, and at least one secondary shelf 150 removably disposed on at least a portion of the external surface 10 to receive at least one second item thereon.

The at least one primary shelf 110 may be folded toward the external surface 10 in response to the plurality of brackets 120 being retracted against the external surface 10.

The at least one primary shelf 110 may be perpendicularly disposed away from the external surface 10 with respect to a direction in response to the plurality of brackets 120 being fully extended away from the external surface 10.

The foldable shelving 100 may further include a plurality of bracket receiving grooves 140 disposed on at least a portion of the at least one primary shelf 110 to receive the plurality of brackets 120 therein.

The plurality of brackets 120 may be nested within the plurality of bracket receiving grooves 140 in response to folding the at least one primary shelf 110 toward the external surface 10 and the plurality of brackets 120 are retracted against the external surface 10.

The foldable shelving 100 may further include at least one extendable surface 160 connected to the at least one secondary shelf 150 to receive at least one third item thereon, and extend away from the at least one secondary shelf 150 in a first position and retract under the at least one secondary shelf 150 in a second position.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

The invention claimed is:

1. Foldable shelving, comprising:

at least one primary shelf removably disposed on at least a portion of an external surface to receive at least one first item thereon;

a plurality of folding brackets movably connected to at least a portion of the at least one primary shelf to move from retracted against the external surface in a first position to at least partially extended away from the external surface along a length of the at least one primary shelf in a second position, and to move from extended away from the external surface along the length of the at least one primary shelf in the second position to retracted against the external surface in the first position;

at least one secondary shelf removably disposed on at least a portion of the external surface to receive at least one second item thereon, wherein the at least one primary shelf is folded toward the external surface in response to the plurality of brackets being retracted against the external surface; and a plurality of bracket receiving grooves disposed on at least a portion of the at least primary shelf to receive at least a portion of the plurality of brackets therein such that the plurality brackets are retracted against the external surface and being partially disposed within the plurality of bracket receiving grooves.

2. The foldable shelving of claim 1, wherein the at least one primary shelf is perpendicularly disposed away from the external surface with respect to a direction in response to the plurality of brackets being fully extended away from the external surface.

3. The foldable shelving of claim 1, wherein the plurality of brackets are nested within the plurality of bracket receiving grooves in response to folding the at least one primary shelf toward the external surface and the plurality of brackets are retracted against the external surface.

4. The foldable shelving of claim 1, further comprising:

at least one extendable surface connected to the at least one secondary shelf to receive at least one third item thereon, and extend away from the at least one secondary shelf in a first position and retract under the at least one secondary shelf in a second position.

* * * * *